US007380379B2

(12) United States Patent
Venegas, Jr.

(10) Patent No.: US 7,380,379 B2
(45) Date of Patent: Jun. 3, 2008

(54) EXPLOSION-ABSORBING PANELS AND WALL STRUCTURES

(76) Inventor: Frank Venegas, Jr., 5682 Lake Ridge Dr., Brighton, MI (US) 48116

( * ) Notice: Subject to any disclaimer, the term of this patent is extended or adjusted under 35 U.S.C. 154(b) by 513 days.

(21) Appl. No.: 10/798,635

(22) Filed: Mar. 11, 2004

(65) Prior Publication Data

US 2007/0163189 A1 Jul. 19, 2007

(51) Int. Cl.
*E04H 17/16* (2006.01)

(52) U.S. Cl. ..... 52/222; 256/73

(58) Field of Classification Search ..... 256/73, 256/24; 52/222, 741.3, 745.05, 1, 98, 100
See application file for complete search history.

(56) References Cited

U.S. PATENT DOCUMENTS

| | | | | | |
|---|---|---|---|---|---|
| 3,933,311 | A | * | 1/1976 | Lemelson | 239/276 |
| 4,116,420 | A | * | 9/1978 | Hazelett | 256/24 |
| 4,225,120 | A | * | 9/1980 | McLaughlin | 256/24 |
| 4,269,004 | A | | 5/1981 | Schiebroek | |
| 4,364,546 | A | * | 12/1982 | Lyman et al. | 256/24 |
| 4,502,812 | A | | 3/1985 | Zucker | |
| 4,666,331 | A | | 5/1987 | Riley | |
| 4,690,383 | A | * | 9/1987 | Batcheller | 256/24 |
| 4,769,191 | A | | 9/1988 | Diana | |
| 4,818,137 | A | | 4/1989 | Gorlov | |
| 4,916,859 | A | | 4/1990 | Butler | |
| 4,989,835 | A | | 2/1991 | Hirsh | |
| 5,026,203 | A | | 6/1991 | Gorlov | |
| 5,123,773 | A | | 6/1992 | Yodock | |

(Continued)

*Primary Examiner*—David Dunn
(74) *Attorney, Agent, or Firm*—Gifford, Krass, Sprinkle, Anderson & Citkowski, PC

(57) ABSTRACT

This invention resides in explosion-resistant walls, panels and partitions, particularly for use around buildings, works of art, public places, and so forth, and wherein, in certain embodiments, may include textures and/or graphics to disguise and/or beautify the structure. In terms of a typical construction, the system includes a plurality of vertical metal pipes, with a portion of each pipe being preferably buried several feet below the ground surface, and a portion of the pipe remains exposed above ground. Two or more horizontal metal pipes are interconnected to the vertical metal pipes, creating apertures that are filled with explosion-absorbing panels. In contrast to "explosion-proof" panels, which require sufficient strength to remain in tact in the presence of a blast, the infill panels according to the invention some form of attachment mechanism which "gives way" in the presence of an explosion, thereby effectively absorbing the shock. In alternative embodiments, the infill panels may be constructed of a fabric such Kevlar, or other material or mesh, which either deforms or breaks upon the impact of a blast. Alternatively, a solid panel of metal or even thick acrylic or other polymeric may be used, which becomes detached from the frame structure upon impact, but does not get thrown in an uncontrolled manner. Rather, hinges or tethers keep the dislodged panels connected to the frame structure. In the preferred embodiment, the pipes are made of steel, and one or more of the pipes may be filled with a fortifying material, such as cement. A cover may be provided to visually obscure the pipes. Such a cover may give the appearance of brick, cinder block, stone or wood. In addition, the system may include a floral decorative element. For example, the infill panels may be die-cut or painted to look like foliage or the building or other environment the barrier is intended to protect.

7 Claims, 1 Drawing Sheet

U.S. PATENT DOCUMENTS 5,152,508 A * 10/1992 Fish ..... 256/24
5,213,312 A * 5/1993 MacDonald ..... 256/26
5,310,277 A 5/1994 Uotila
5,402,988 A * 4/1995 Eisele ..... 256/24
5,441,359 A 8/1995 Filippi
5,628,495 A * 5/1997 Gandara ..... 256/24
5,651,635 A 7/1997 Nagle
5,746,538 A 5/1998 Gunness
5,961,099 A * 10/1999 Thommen, Jr. ..... 256/12.5
5,975,791 A 11/1999 McCulloch
6,062,765 A 5/2000 Dotson
6,186,274 B1 * 2/2001 Reynolds et al. ..... 182/138
6,712,339 B1 * 3/2004 Smith ..... 256/10
2002/0184839 A1 12/2002 Emek
2003/0127122 A1 7/2003 Gower
2003/0145534 A1 8/2003 Hojaji et al.
2003/0178614 A1 * 9/2003 Venegas, Jr. ..... 256/65.1
2003/0200716 A1 10/2003 Manthel
2003/0210953 A1 11/2003 Williams et al.
2003/0219308 A1 11/2003 Boulais et al.

* cited by examiner

EXPLOSION-ABSORBING PANELS AND WALL STRUCTURES

FIELD OF THE INVENTION

This invention relates generally to shock- and explosion-absorbing structures and, more particularly, to walls and panels for reducing injuries and casualties in the event of a terrorist bombing or other threat.

BACKGROUND OF THE INVENTION

Since the Sep. 11, 2001 attacks on the World Trade Center and Pentagon, there has been significant interest in providing enhanced security around buildings and public places. One need is for barriers around buildings and other structures to prevent trucks and other vehicles, perhaps carrying explosives, or just intent upon inflicting damage, from crashing into walls, and so forth. In addition to a need for high-strength barriers of this kind, at the same time, such structures should not be visually offensive, and indeed, it would be beneficial if such barriers were aesthetically appealing, blending into the environment.

One solution is proposed in published U.S. Patent Application No. 2003/0127122, which teaches a flexible blast curtain said to reduce casualties and property damage in the event of a terrorist bombing by intercepting flying debris and dissipating over pressure through deflection of the curtain. The blast curtain may be attached directly to buildings or mounted on frames anchored in close proximity to buildings. The curtain provides complete visibility and easy pedestrian ingress and egress for the buildings.

The curtain is in the form of a flexible barrier which is placed a distance out from the surface to be protected. An impacting missile stretches the barrier until it decelerates to a stop or is deflected. The barrier material has a predetermined tensile strength and stretch that makes it suitable for this application. The known strength and stretch, together with the speed, weight and size of the impacting missile, all of which are given in test requirements, permit design calculation to ascertain barrier deflection at impact. This deflection is a determinate of the minimum distance that this barrier is to be spaced out from the frangible area to be protected.

Published U.S. Patent Application No. 2003/0145534 resides in a large, high-density foam glass tile which can be used as a facade on both exterior and interior building walls. The foam glass tile can also be used with other materials to form a panel or a composite. The invention may be used on the critical surfaces of buildings at high risk for terrorist attacks, in combination with cement, steel or other high strength building materials, and may also be used in surfaces of typical buildings. It purportedly has the advantage of absorbing a substantial portion of a shock wave caused by an explosion, while being more resistant to earthquakes.

According to published U.S. Patent Application No. 2003/0200716, a wall is constructed from precast concrete blocks stacked in tiers in which adjacent blocks are secured together to increase the strength of the wall. Anchors are embedded in the tops of at least some of the blocks. The ends of the blocks have vertical grooves which form a vertical opening when the ends of two blocks abut. The blocks in the tiers are offset so that the openings between blocks in one tier are positioned above the anchors on the blocks on the adjacent lower tier. The blocks in each tier are secured together by a tensioned cable extending through aligned passages in the blocks. Locking members are placed in the openings to secure the ends of the abutting blocks to an anchor in an adjacent lower block.

The window system is fitted with a blast energy absorbing mechanism wherein the support members are formed with at least one arm which at a mounted state of the support frame, extends opposite a corresponding flange associated with the frame, i.e. integral with the frame or otherwise articulated thereto. In accordance with an embodiment of the invention, the flange is a portion of the fixing members adapted for engagement with a corresponding first arm of a support member. In accordance with a further embodiment of the invention the flange is an extension of the frame adapted for engagement with a corresponding second arm of a support member.

A dismantable protective window is disclosed in published U.S. Patent Application No. 20020184839. By one particular embodiment of the invention, the support members are bifurcated elements having a first arm and a second arm, which arms at a mounted state of the support frame, extend opposite a corresponding portion of the fixing members and an extension flange of the frame. The arrangement is such that a shock wave striking the window pane gives rise to generation of forces acting in the plane of the window pane and orthogonally thereto, displacing the support frame in an inward, radial direction, whereby the at least one arm of the support members engage the corresponding flanges.

SUMMARY OF THE INVENTION

This invention resides in explosion-resistant walls, panels and partitions, particularly for use around buildings, works of art, public places, and so forth, and wherein, in certain embodiments, may include textures and/or graphics to disguise and/or beautify the structure. In terms of a typical construction, the system includes a plurality of vertical metal pipes, with a portion of each pipe being preferably buried several feet below the ground surface, and a portion of the pipe remains exposed above ground.

Two or more horizontal metal pipes are interconnected to the vertical metal pipes, creating apertures that are filled with explosion-absorbing panels. In contrast to "explosion-proof" panels, which require sufficient strength to remain in tact in the presence of a blast, the infill panels according to the invention some form of attachment mechanism which "gives way" in the presence of an explosion, thereby effectively absorbing the shock. In alternative embodiments, the infill panels may be constructed of a fabric such Kevlar, or other material or mesh, which either deforms or breaks upon the impact of a blast. Alternatively, a solid panel of metal or even thick acrylic or other polymeric may be used, which becomes detached from the frame structure upon impact, but does not get thrown in an uncontrolled manner. Rather, hinges or tethers keep the dislodged panels connected to the frame structure.

In the preferred embodiment, the pipes are made of steel, and one or more of the pipes may be filled with a fortifying material, such as cement. A cover may be provided to visually obscure the pipes. Such a cover may give the appearance of brick, cinder block, stone or wood. In addition, the system may include a floral decorative element. For example, the infill panels may be die-cut or painted to look like foliage or the building or other environment the barrier is intended to protect.

DETAILED DESCRIPTION OF THE INVENTION

Figure 1:
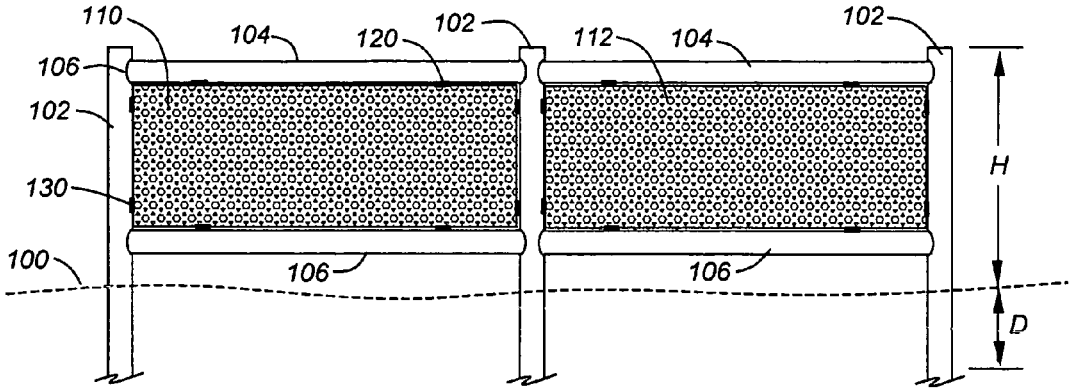
FIG. 1 illustrates the preferred embodiment of the present invention.

FIG. 1 is a drawing of a preferred embodiment of the invention, including a plurality of vertical tubular (i.e., steel) members 102, interconnected by two or more horizontal members 104, 106, also preferably constructed of tubular steel. The pipes may, or may not, be filled with other strengthening materials, including cement. Preferably, the vertical members are sunken several feet into the earth at a distance "D" at least past the frost line, and surrounded and filled in with cement or concrete. To further enhance security, reinforcing elements or "re-rods" may be used, as shown in pending U.S. patent application Ser. No. 10/427,059, the entire content of which is incorporated herein by reference. The height of the structure, indicated by "H," may range from a few feet to much higher, in which case 3 or more horizontal members would preferably be used.

The horizontal members 104, 106 are preferably welded to the vertical members utilizing a saddle-type weld for the greatest strength. This creates rectangular apertures founded by the welded tubular members, and these are filled with panels 110, 112 according to the invention. However, rather than these panels being strong enough to actually resist the shock due to an explosion or bombing, they are meant to give way in one manner or another according to the invention. In FIG. 1, the panels are held in position with break-away brackets or clamp 120, 130, which, upon a predetermined force, break away, allowing the panel to become dislodged from the frame structure. If the barrier of FIG. 1 is sufficiently far away from humans or buildings or other items to be protected, no tethering to the frame structure would be required. However, since it is desirable to place the structure of FIG. 1 close to buildings and pedestrian traffic, a different break-away mechanisms are preferably used.

Figure 2:
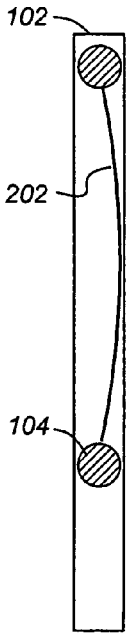
FIG. 2 shows the way in which a panel may undergo deformation in the presence of a blast.
Figure 3:
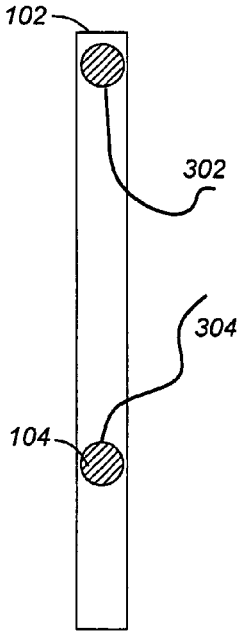
FIG. 3 shows the way in which a panel may break in the presence of a blast.
Figure 4:
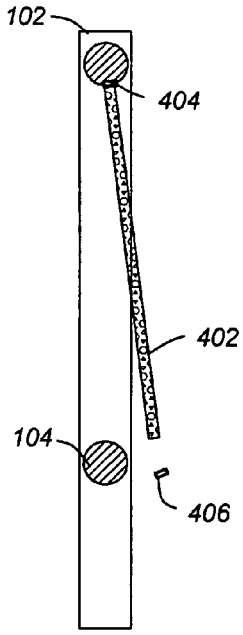
FIG. 4 shows an alternative embodiment including a hinged panel.
Figure 5:
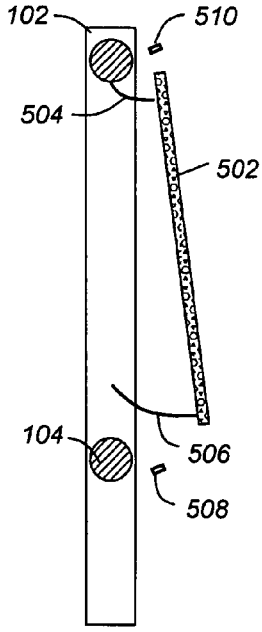
FIG. 5 shows yet a further alternative wherein a dislodged panel is retained with tethers.

For example as shown in FIG. 2, a fabric or material such as Kevlar or other shock-absorbing material is stretched between the members, and this becomes deformed upon impact. The deformation may be temporary or, as shown in FIG. 3, it may be permanent, resulting in a rupture in separate pieces 302, 304 which would need to be replaced.

In the preferred embodiment, a solid, heavy rigid panel 402 is used, which could be plate steel or the like. In the alternative, a thick clear acrylic, or safety glass could alternatively be utilized. In such a case, a panel would preferably be hinged at 404, such that upon a sufficiently large blast, a bracket or retaining member 406 would become comprised or expelled, allowing the panel 402 to hinge and absorb the blast. Although a certain level of maintenance would be required thereafter, this is certainly more acceptable than the alternative.

In a further preferred embodiment, a rigid panel 502 is used, but instead of a hinge mechanism, tethers 504, 506 are used to keep the panel 502 at least close to the barrier 102 upon impact, in which case elements 508, 510 originally holding the panel in place would become comprised or expelled. In a further alternative, the tethers 504, 506 may themselves be intended to break or rupture at a second, higher level of shock, thereby resulting in further energy absorption.

In terms of decorative features, the panels 202, 402, 504 may either be solid, die-cut with a design, or clear in the case of a rupturable safety glass or thick acrylic. If the panel or fabric is not transparent or semi-transparent, a design may be die-cut or painted on the surface, thereby resulting in an aesthetically pleasing, yet effective barrier system.

I claim:

1. An energy-absorbing barrier system, comprising:

a plurality of spaced-apart vertical metal pipes, each buried below a ground surface, leaving a portion exposed above ground;

two or more spaced-apart horizontal metal pipes interconnected to the vertical metal pipes creating at least one infill area;

a material spanning the infill area which is operative to absorb at least a portion of the impact of an explosive blast;

a material spanning the infill area being fastened to the horizontal or vertical pipes with mounts that break away upon a predetermined force; and a material spanning the infill area is tethered to one or more of the horizontal or vertical pipes to keep the material from uncontrolled travel upon impact.

2. The energy-absorbing barrier system of claim 1, wherein one or more of the pipes are filled with cement.

3. The energy-absorbing barrier system of claim 1, wherein the metal pipes are steel.

4. The energy-absorbing barrier system of claim 1, further including a plastic cover over one or more of the pipes.

5. The energy-absorbing barrier system of claim 1, wherein the material spanning the infill area is a fabric that deforms to absorb energy.

6. The energy-absorbing barrier system of claim 1, wherein the material spanning the infill area ruptures to absorb energy.

7. The energy-absorbing barrier system of claim 1, wherein the material spanning the infill area is hinged to a horizontal pipe to swing upon impact.

* * * * *